United States Patent [19]

Wilkinson et al.

[11] Patent Number: 4,478,022

[45] Date of Patent: Oct. 23, 1984

[54] INSULATION SYSTEM AND METHOD AND APPARATUS FOR RETAINING SAME

[75] Inventors: Harold C. Wilkinson, Medford; Charles C. Pease, Vincentown; Kevin Wall, Medford Lakes, all of N.J.

[73] Assignee: KSM Fastening Systems Inc., Moorestown, N.J.

[21] Appl. No.: 379,312

[22] Filed: May 18, 1982

[51] Int. Cl.[3] ..... E04B 1/38

[52] U.S. Cl. ..... 52/509; 52/747

[58] Field of Search ..... 52/410, 506, 509, 741, 52/747; 264/30; 110/336, 338, 339, 340

[56] References Cited

U.S. PATENT DOCUMENTS

| | | | |
|---|---|---|---|
| 1,197,842 | 9/1916 | Meier | 52/509 |
| 2,518,640 | 8/1950 | Purinton | 52/410 |
| 3,523,395 | 8/1970 | Rutter et al. | 52/410 |
| 3,738,217 | 6/1973 | Walker | 52/506 X |
| 3,763,796 | 10/1973 | Venable, Jr. | 52/568 X |
| 3,819,468 | 6/1974 | Sauder et al. | 428/99 |
| 3,892,396 | 7/1975 | Monaghan | 266/43 |
| 3,960,460 | 6/1976 | Fischer | 403/292 |
| 4,177,616 | 12/1979 | Lampert | 52/509 |
| 4,288,951 | 9/1981 | Carlson et al. | 52/94 |
| 4,291,514 | 9/1981 | Harvey | 52/714 X |

FOREIGN PATENT DOCUMENTS

| | | | |
|---|---|---|---|
| 516855 | 1/1953 | Belgium | 52/509 |

*Primary Examiner*—Carl D. Friedman

*Attorney, Agent, or Firm*—Duffield & Lehrer

[57] ABSTRACT

An insulating system for walls of furnaces, kilns and the like including apparatus and methods for retaining the system in place. The system includes a crisscross pattern of insulation blankets positioned against the wall, a vapor barrier and high temperature modular insulation blocks positioned against the vapor barrier. The apparatus and methods for retaining the system in place utilize studs welded to the wall upon which the insulation blanket and vapor barrier are impaled and between which are positioned the modular blocks. A block retaining pin with a notched portion midway thereof cooperates with an aperture in the end of the stud permitting the pin to pass through the aperture of the stud piercing the wall of block to retain the block while the pin is rotated to provide an interlock of the notched portion of the pin with the aperture of the stud.

6 Claims, 6 Drawing Figures

INSULATION SYSTEM AND METHOD AND APPARATUS FOR RETAINING SAME

BACKGROUND OF INVENTION

The present invention applies to the art of securing insulation to the walls of furnaces, kilns, soaking pits and the like and, more particularly, to securing a combination insulation blanket and modular block insulation to the inner walls of such structures.

Several years ago, the predominant method of insulating such heating apparatus as furnaces, incinerators and other devices of that nature was to use the heretofore conventional and well-known firebrick. The process of bricking the heated areas was expensive from a labor standpoint and extremely time consuming. Additionally, repair and replacement of the brick lining in such structures was both expensive and time consuming.

More recent developments in the art of insulating furnaces and such structures in the utilization of insulating blankets formed of ceramic materials or ceramic glass such as alumina. These blankets come in varying thicknesses from 1 to 3 inches and are formed into rolls of varying widths.

During the insulating process, the blankets are applied to the walls of the structure in layers of anywhere from 1 to 3 layers and often in a crisscross pattern. The blankets may be secured to the walls of the furnace or other structure in a number of different ways.

In nearly all heating devices such as furnaces and the like, the wall to which the blankets are supported is a metallic wall known as the cold wall. One manner of securing the blankets to the cold wall is the utilization of a threaded fastener which employs a drill point and self tapping combination on the end of the fastener. The fastener is drilled and threaded into the wall and projects outward from the wall. A number of these fasteners are spaced along the wall and blankets impaled upon the fasteners. Thereafter, a washer and nut are applied to the threaded fastener to pull the blanket down into secured position.

Another device which is used for smaller blankets is a pin which has a large washer secured on the end of the pin. The pin is pushed through the blanket and against the metallic cold wall and stud welded in place to secure the blanket.

A third device in prevalent use is a stud and washer combination wherein the stud includes a plurality of tapered notches. The studs are welded to the cold wall in a given array or fashion and the blanket impaled upon the studs. Thereafter, the washers, which have a complementary aperture therein, are placed over the stud to compress the blanket and rotated 90° and released whereupon the blanket brings the washer into locking engagement with the stud.

The blanket insulating systems have certain drawbacks. One of them is that the fastening means for securing the blankets in place constitute what is called an exposed system, i.e. the outermost ends of the retaining means are exposed to the heat. This often results in burning off of the retaining means and consequent loosening of the blanket. Another drawback of the blanket system is that the blankets generally are not made in thicknesses in excess of 3 inches. Accordingly, if an insulation depth of several inches is required, i.e. as high as 12 inches, then many blankets must be crisscrossed over one another to acquire the required depth. This is costly and time consuming.

A more recent development in the industry is the utilization of what are known as modular insulation blocks. These blocks generally come in configurations of 1 foot square and can range in depths from 4 to 12 inches. One advantage of the modular blocks is that the required depth can be obtained in the single installation. Additionally, the blocks may be of varying density, i.e. higher density and greater insulating qualities toward the hot face than back toward the cold face.

The modular blocks may be secured to the wall of the furnace or the like in a number of ways. One type of retaining device is a wire retainer that is shaped in an H configuration which has 4 projecting prongs interconnected to a central portion. The central portion has an offset portion which is welded to the cold wall of the furnace. A given modular insulation block is impaled upon a pair of the prongs. Thereafter, a next H configured device is shoved into the opposite wall of the block and welded in place followed by another block being placed upon the opposing projecting pair of prongs. The process is repeated until a plurality of blocks form the modular block wall.

Another method of securing the modular insulation blocks is to utilize a metallic expanded metal backing on the blocks. The blocks are positioned in place against the wall of the furnace with the expanded metal against the furnace wall. Thereafter, a collar stud is pushed through the block into contact with the expanded metal and furnace wall and stud welded to secure the modular block in place. Additionally, self tapping threaded members may be employed which are pushed through the block and drilled and threaded into the wall of the furnace. Thereafter, a washer and nut are placed on the threaded member and tightened against the expanded metal to hold the blocks in place.

The advantages of the modular blocks over the insulation blankets are the ease of assembly and the ability to obtain the required insulation thickness quickly. Additionally, the fastening systems used for the modular blocks are not exposed to the hot face and the likelihood of burnoff of the retaining device is substantially less. However, there are certain drawbacks also. One of the drawbacks is that the modular blocks are subject to a certain amount of shrinkage upon heating. As this shrinkage occurs, the interface between adjacent blocks may open permitting heat to migrate between the blocks with possible damage to the cold face of the furnace. Additionally, this possible opening at the interface of the blocks often permits passage of corrosive vapors and the like to the cold face of the furnace.

There are many applications in the industry wherein the advantages of both the insulating blanket and the modular blocks can be effectively taken advantage of. For example, it would be advantageous to have 1 to 2 layers of insulating blanket crisscrossed covered with a vapor barrier to provide the advantages of total integrity of the system against penetration of heat and vapors through the insulation. At the same time, the advantages of the modular blocks may be had by applying the blocks to the outer surface of the insulation blankets and vapor barrier wherein the modular blocks add the advantage of factory controlled blocks of varying density and the ability to build to the desired thickness quickly, efficiently and inexpensively.

A combination insulation blanket-vapor barrier-modular block system is needed by the industry but has been unobtainable or impractical heretofore. The H anchors heretofore utilized to secure the modular blocks cannot be used with the blanket or vapor barriers inasmuch as the blanket and/or vapor barriers cannot be impaled over the H configured retaining devices.

In a like manner, the stud welding method of securing the insulation blocks in place cannot be used inasmuch as the back surface of the insulation block in such a combination will not be against a metallic cold face of the furnace. Additionally, the self tapping threaded fasteners are not practical since their initial concept of usage is to drill, tap and secure the modular block once the block is in place which does not provide any way of securing the blanket and vapor barrier prior to placing of the blocks. It would be impractical to drill and tap the threaded devices prior to installing of the modular blocks in that alignment and threading of the nut and washers to the device thereafter would require a separate operation and be time consuming and costly.

SUMMARY OF INVENTION

The present invention provides apparatus and methods for retaining modular insulation blocks and also an insulation system utilizing methods and apparatus which provide a combination insulation blanket-vapor barrier-modular insulation block insulating system for use in furnaces, kilns and the like.

The retaining apparatus and methods utilize an elongate end weldable stud which is welded to the cold face of the furnace or the like and projects outwardly from the cold face generally at a right angle. The studs are welded in a given array or pattern approximating the width of the insulating block. The studs are of a length slightly less than the combined thickness of the insulation block and insulation blankets if to be used. The studs contain, at the outer end thereof, an elongate aperture.

In accordance with the invention, if an insulation blanket and vapor barrier are used, the insulation blanket or blankets are impaled upon the studs in a crisscross fashion and the vapor barrier likewise impaled upon the studs and placed against the outermost insulation blanket. A refractory seal is placed around the vapor barrier at the point where the stud pierces the vapor barrier to provide a vapor seal.

A modular block retaining pin is provided which is an elongate flat pin with opposed notches generally midway of the pin. The retaining pin is slid into the aperture of the stud to the point of the notches. The configuration of the notches and the aperture is such that the pin can be rotated 90° in the aperture past a slight interference fit and thus interlock with the stud against further translational movement of the retaining pin relative to the stud.

Following positioning of the retaining pin with the stud, an insulation block is impaled upon the retaining pin at one of its side faces and the opposing side face pushed down into engagement with the adjacent stud. Thereafter, a further retaining pin is passed through the aperture in the stud piercing the opposing side wall of the modular insulation block until the notches reach the aperture. Thereafter, the retaining pin is rotated into locking engagement with the stud.

The process is continued on a block by block basis until the surface to be insulated has been fully covered with the combination insulation blanket-vapor barrier-modular insulation block assembly.

DETAILED DESCRIPTION OF INVENTION

FIGS. 1–6 of the drawings illustrate the insulation system of the present invention which utilizes the combination of an insulation blanket, vapor barrier and insulating modular block as well as the retaining apparatus for retaining the insulation system.

Figure 1:
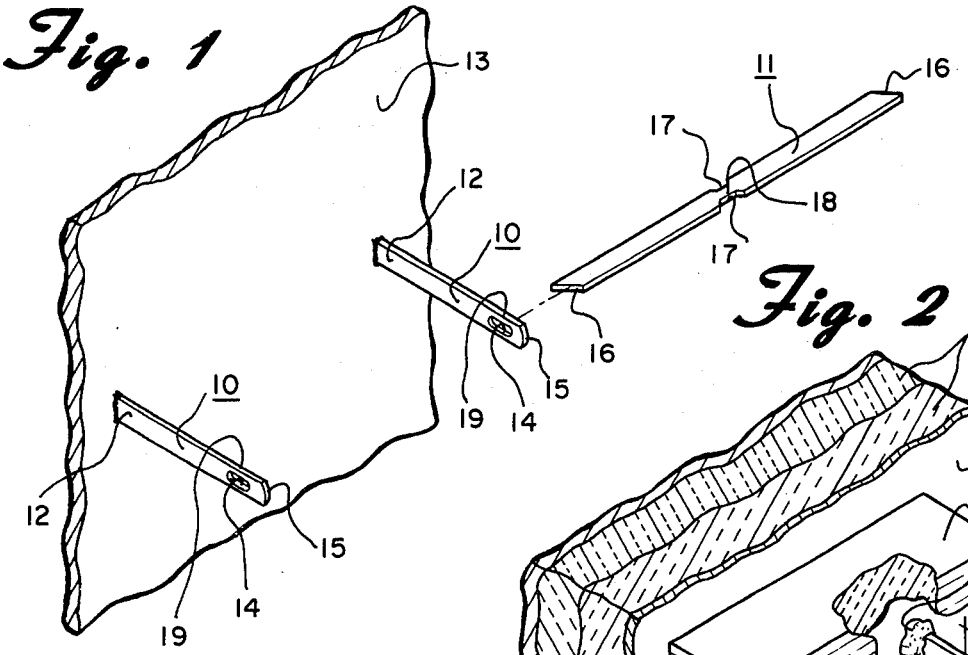
FIG. 1 is a perspective view of the stud and retaining pin of the present invention in relation to the wall of the furnace.
Figure 4:
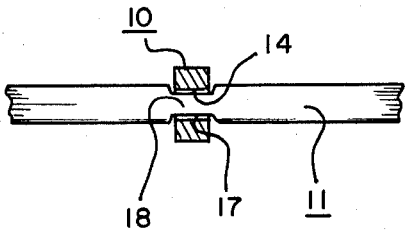
FIG. 4 is a sectional view of the retaining pin interlocked with the aperture of the stud.

The retaining apparatus for the system is best shown in FIGS. 1 and 4 of the drawings and consists of an elongate end weldable stud 10 and an elongate block retaining pin 11.

The stud 10 includes a first end thereof 12 which is adapted to be welded by the stud end welding technique to the metal cold face 13 of a furnace, kiln or the like as shown in FIG. 1. The stud 10 is preferably of a rectangular flat cross section.

An aperture 14 is punched or otherwise formed at the opposite end 15 of the stud. The aperture is an elongate rectangular aperture.

The elongate block retaining pin 11 is generally of a flat rectangular cross section. Each end 16 of the pin is cut off at a diagonal angle to provide a sharp point. Midway of the pin 11 is a deformation which in a specific embodiment, is a pair of opposed notches 17 cut or otherwise formed into the retaining pin. A singular notch can also be used if desired.

Figure 5:
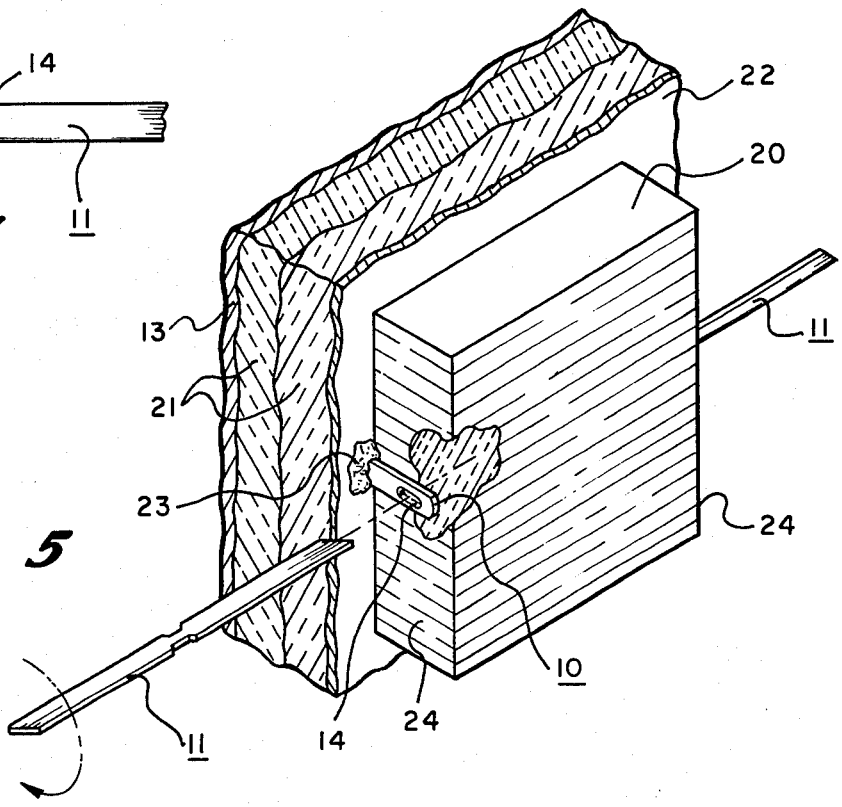
FIG. 5 is a perspective view of the assembly of FIG. 3 illustrating the placement of a second retaining pin into a given modular insulating block.

The cross section of the aperture 14 is essentially complementary but slightly larger than the cross section of the retaining pin 11. In this manner, the retaining pin may pass through the aperture when aligned with the aperture as shown in FIGS. 1, 2 and 5.

The notches 17 are formed into the retaining pin of a depth such that the diagonal distance of the remaining center portion 18 is slightly in excess of the shorter dimension of the rectangular aperture 14. As illustrated in FIG. 4, the retaining pin 11 may pass through the aperture 14 to the point of the notches 17. At this time, the retaining pin 11 is rotated until the diagonal distance of the center section 18 engages the longer sides of the aperture 14. Continued rotation of the retaining pin 11 will permit deflection of the side walls 19 of the aperture 14 permitting the interference to be overcome and the retaining pin 11 to snap into interlocked relationship with the stud at the point of 90° of rotation. In this manner, as shown in FIG. 4, the retaining pin 11 is interlocked with the stud 10 against translational movement in the aperture.

Figure 2:
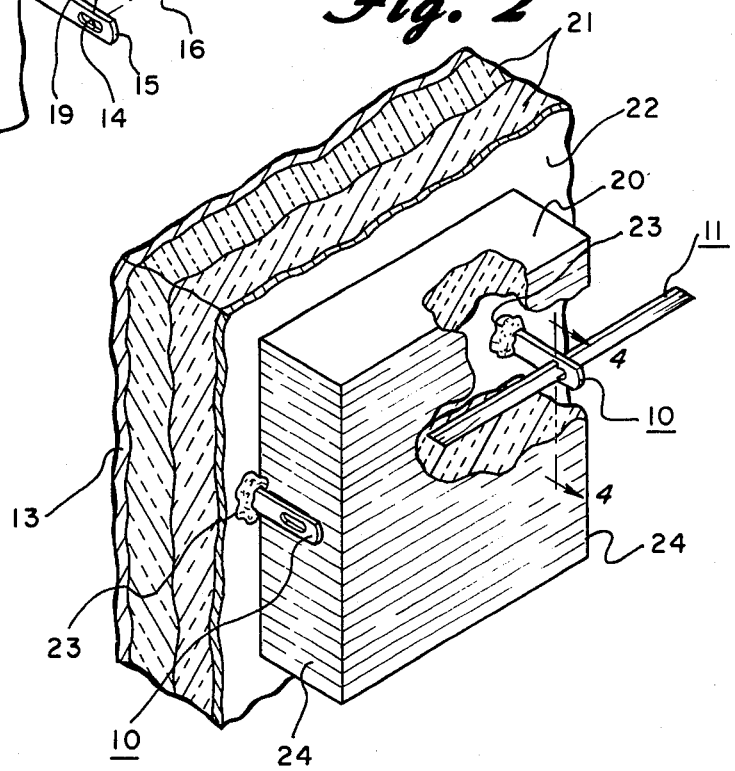
FIG. 2 is a perspective view of two layers of insulation blanket and vapor barrier in position upon the studs and prior to interlock of the retaining pin with the studs.
Figure 3:
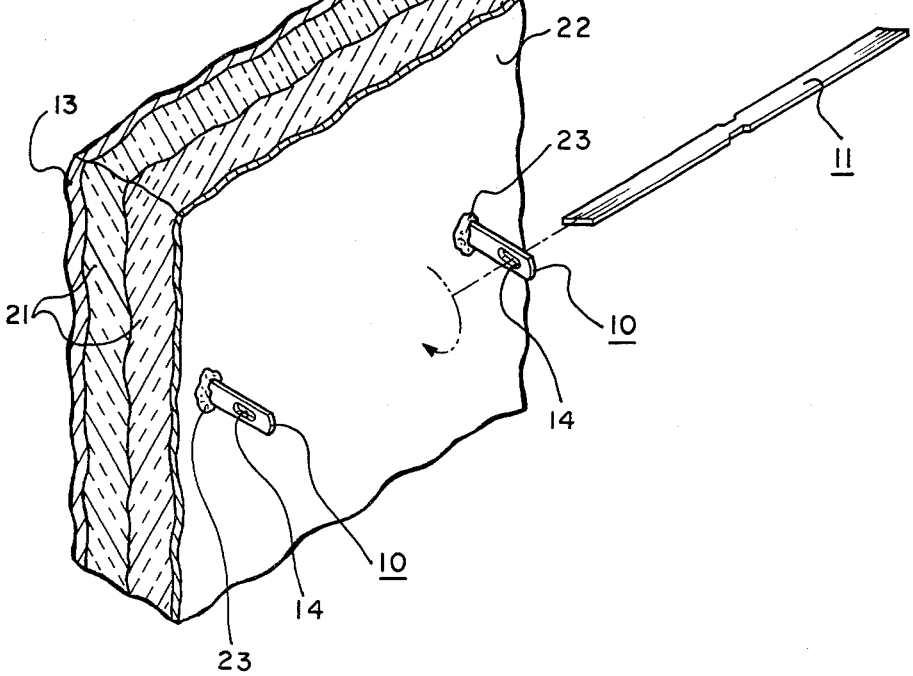
FIG. 3 is a perspective view of the assembled combination of two layers of insulation blanket, vapor barrier and a modular insulating block in place upon a first stud and interlocked retaining pin.

In assembling the system, a plurality of studs 10 are welded in an array spaced apart the width of the modular insulating block 20 as shown in FIGS. 1–3. Following welding of the studs 10 to the cold face 13 of the furnace, the number of desired insulation blankets 21 are impaled upon the studs 10. Where two or more insulation blankets are utilized, they will be generally crisscrossed, i.e. turned at 90° directions to one another to provide closing of the edges of the rolls of the blanket.

Following placement of the blanket upon the studs and against the cold face 13, a vapor barrier 22 is likewise positioned by being impaled upon the studs 10. Once the insulation blanket 22 is in place, an appropriate sealing material 23 is placed around the point where the studs 10 pierce the vapor barrier.

Once the insulation blankets and vapor barrier and sealant are in place, the modular insulation blocks are next assembled in place. This is begun by taking a first retaining pin 11 and passing it through the aperture 14 of the stud 10 and interlocking it into place as shown in FIG. 3 of the drawings. Next, the block is compressed against the blankets and vapor barrier with a slight pressure to compress the blanket to provide resiliency to the system. Thereafter, the insulation block 20 is then impaled upon the retaining pin 11. It is to be noted that the retaining pin 11, when interlocked with the stud 10, is somewhat free such that the pin may be inclined slightly outwardly from the furnace wall to facilitate impaling of the insulation block 20 through its side wall 24 upon the retaining pin at an inclined angle to provide clearance of the insulating block 20 with the adjacent stud 10. Once the insulation block is impaled upon the retaining pin 11 with its righthand side wall 24 against the stud 10, the block is pushed into place with its lefthand side wall 24 against the adjacent stud 10.

As shown in FIG. 5, once the insulation block 20 is in place, a further retaining pin 11 is passed through the aperture 14 of the adjacent stud 10 piercing the lefthand side wall 24 of the insulation block 20 to the point at which the notches encounter the aperture. Thereafter, the retaining pin 11 is rotated 90° into the interlocking engagement with the adjacent stud 10 thus completing the securing of a given insulating block 20.

Figure 6:
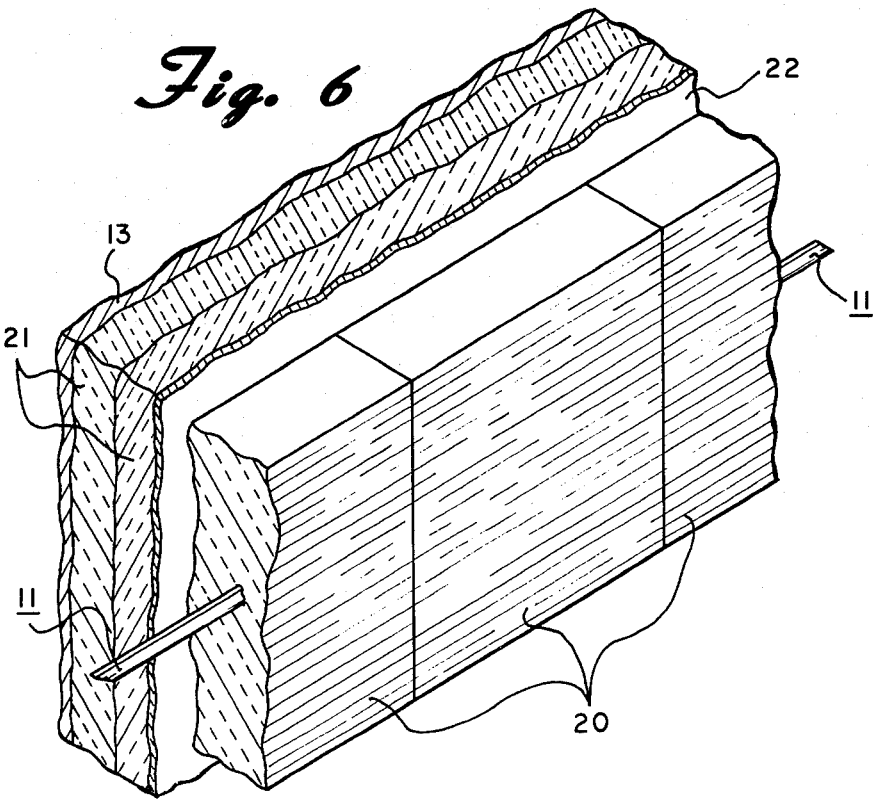
FIG. 6 is a perspective view of a series of modular insulating blocks in place upon a dual insulation blanket and vapor barrier.

The foregoing procedures are repeated for the next adjacent block in a row shown in FIG. 6. In this manner, row after row of blocks spaced one upon another may be assembled to provide a combined insulating blanket-vapor barrier-modular insulating block combination.

While the apparatus for retaining the modular blocks has been shown in combination with insulation blankets, the apparatus including the stud and retaining pin may equally be used for retaining modular insulating blocks alone without insulating blankets and vapor barriers.

In a given embodiment and by way of example only, the insulation blankets may be of approximately 1 inch thickness each and formed of a fibrous alumina glass. The insulation material comes in rolls of 18 inches in width and 25 feet in length. The vapor barrier may be of either aluminum foil or of a stainless steel foil. The sealant between the studs and vapor barrier may be sodium silicate and clay. The insulation block is of a 1 foot square configuration and may range in thickness for 4 inches to 12 inches and is likewise formed of alumina.

The stud is formed of a stainless steel material and of a cross section of 0.375 inches × 0.125 inches. The length of the stud will depend upon the combined thicknesses of the insulation blankets and/or modular blocks and be of length slightly less than the combined thickness.

The retaining pin is formed of a stainless steel material. The cross section of the retaining pin is 0.250 inches × 0.125 inches. The notches are cut into the retaining pin to a depth to leave the center portion of a diagonal distance presenting approximately 0.011 inches interference.

Rotation of the retaining pin for interlock within the aperture of the stud may be accomplished by any suitable tool. An unwelded stud itself may be used as a convenient tool when slid partially upon the retaining pin to provide the necessary leverage for rotation.

The insulation system, apparatus for securing same and methods of securing same have been described in respect to the particular embodiments set forth in the specification and as shown in the drawings. No limitation as to the scope of the invention is intended by the description thereof in respect to the particular embodiments set forth in the specification and the drawings but the scope of the invention is to be interpreted in view of the appended claims.

What is claimed is:

1. An insulation system for insulating metallic walled structures such as furnaces, kilns and the like comprising:

a plurality of elongate end weldable metallic studs welded to the metallic wall of the structure in a predetermined array and upstanding from the metallic wall;

at least one insulation blanket impaled over the studs and against the metallic wall;

a plurality of modular insulation blocks having side walls adapted to be positioned in contact with one another between adjacent studs;

an elongate relatively thin block retaining pin;

interlocking means permitting the block retaining pin to pierce the side walls of adjacent insulation blocks while interlocking with the stud; and wherein the interlocking means includes an aperture in the stud and a cooperating deformation in the pin.

2. The insulation system of claim 1 wherein the configuration of the aperture and the cross section of the pin permit the pin to pass through the aperture to a point of alignment of the deformation with the aperture and interlock with the stud when the pin is rotated.

3. The insulation system of claim 2 wherein the dimension of the deformation of the pin relative to the dimension of the aperture of the stud provides a slight interference fit providing positive interlock when the pin is rotated past the interference fit.

4. The insulation system of claim 1 further including a vapor barrier positioned between the insulation blanket and the modular insulation blocks and vapor sealing means between the stud and the vapor barrier.

5. The method of securing a plurality of rectangular insulation blocks to the metallic surface of structures such as kilns, furnaces and the like comprising the steps of:

welding a plurality of elongate end weldable metallic studs having an aperture therein to the metallic wall in a fixed upstanding array approximating one dimension of the insulating blocks;

inserting an elongate relatively thin block retaining pin having a notch approximately midway thereof into the aperture of the stud to the point of the notch and rotating the pin into interlocking relationship with the stud;

impaling a block by its side wall upon the retaining pin and positioning the block between adjacent studs;

inserting a further retaining pin into the aperture of the adjacent stud while piercing the side wall of the insulating block to the point of the notch and rotating the retaining pin into interlocking relationship with the stud; and repeating the steps of placing of adjacent blocks and inserting the retaining pins to construct a modular insulating wall.

6. The method of claim 5 further including the step of impaling at least one layer of insulating blanket over the stud and against the metallic wall of the structure before inserting of retaining pins and placing of modular blocks.

* * * * *